US006026785A

United States Patent [19]

Zuo

[11] Patent Number: 6,026,785

[45] Date of Patent: Feb. 22, 2000

[54] HYDRAULICALLY-ACTUATED FUEL INJECTOR WITH HYDRAULICALLY ASSISTED CLOSURE OF NEEDLE VALVE

[75] Inventor: Lianghe Zuo, Chicago, Ill.

[73] Assignee: Caterpillar Inc., Peoria, Ill.

[21] Appl. No.: 09/074,916

[22] Filed: May 8, 1998

[51] Int. Cl.[7] ..... F02M 51/06

[52] U.S. Cl. ..... 123/446; 123/467

[58] Field of Search ..... 123/446, 447, 123/467

[56] References Cited

U.S. PATENT DOCUMENTS

| | | | |
|---|---|---|---|
| 4,280,464 | 7/1981 | Kanai et al. | 123/447 |
| 4,314,585 | 2/1982 | Nishimiya et al. | 137/625.34 |
| 4,471,740 | 9/1984 | Jourde et al. | 123/446 |
| 4,541,385 | 9/1985 | Eheim et al. | 123/446 |
| 4,616,675 | 10/1986 | Amrhein | 137/625.65 |
| 4,649,886 | 3/1987 | Igushira et al. | 123/498 |
| 4,712,528 | 12/1987 | Schaffitz | 123/446 |
| 4,759,330 | 7/1988 | Kato et al. | 123/446 |
| 4,911,127 | 3/1990 | Perr | 123/446 |
| 5,235,954 | 8/1993 | Sverdlin | 123/447 |
| 5,271,430 | 12/1993 | Muruyama et al. | 137/625.3 |
| 5,460,133 | 10/1995 | Perr et al. | 123/446 |
| 5,460,329 | 10/1995 | Sturman | 239/96 |
| 5,497,750 | 3/1996 | Mueller et al. . | |
| 5,522,364 | 6/1996 | Knight et al. | 123/467 |
| 5,535,723 | 7/1996 | Gibson et al. | 123/446 |
| 5,598,871 | 2/1997 | Sturman et al. | 137/625.65 |
| 5,669,355 | 9/1997 | Gibson et al. | 123/446 |
| 5,682,858 | 11/1997 | Chen et al. | 123/467 |
| 5,687,693 | 11/1997 | Chen et al. | 123/446 |
| 5,720,261 | 2/1998 | Sturman et al. | 123/467 |
| 5,819,704 | 10/1998 | Tarr et al. | 123/467 |

FOREIGN PATENT DOCUMENTS

| | | | |
|---|---|---|---|
| 41 18 237 | 12/1991 | Germany | F02M 45/02 |

*Primary Examiner*—Thomas N. Moulis
*Attorney, Agent, or Firm*—Michael B. McNeil

[57] ABSTRACT

A hydraulically-actuated fuel injector includes an injector body that defines an actuation fluid inlet, a first actuation fluid passage, a second actuation fluid passage, a fuel inlet and a nozzle outlet. A solenoid actuated control valve is attached to the injector body and includes a spool valve member moveable between a first position and a second position. The actuation fluid inlet is closed to the first actuation fluid passage and open to the second actuation fluid passage when the spool valve member is in its first position. The actuation fluid inlet is open to the first actuation fluid passage and closed to the second actuation fluid passage when the spool valve member is in its second position. A piston is positioned in the injector body and moveable between a retracted position and an advanced position. The piston has an upper end exposed to fluid pressure in the first actuation fluid passage. A needle valve member is positioned in the injector body and moveable between an inject position in which the nozzle outlet is open, and a closed position in which the nozzle outlet is blocked. The needle valve member has a closing hydraulic surface exposed to fluid pressure in the second actuation fluid passage.

20 Claims, 4 Drawing Sheets

HYDRAULICALLY-ACTUATED FUEL INJECTOR WITH HYDRAULICALLY ASSISTED CLOSURE OF NEEDLE VALVE

TECHNICAL FIELD

The present invention relates generally to hydraulically-actuated fuel injectors, and more particularly to hydraulically-actuated fuel injectors that utilize a pressurized fluid to assist closure of the needle valve at the end of an injection event.

BACKGROUND ART

U.S. Pat. No. 5,460,329 to Sturman describes a hydraulically-actuated fuel injector that is controlled in its operation with a dual solenoid control valve. Each injection event is initiated by energizing one of the solenoids. This pulls a spool valve member from one position to another position, which suddenly exposes an intensifier piston to a high pressure actuation fluid inlet. The piston begins a downward stroke from the force provided by the high pressure actuation fluid. The piston in turn pushes a plunger that pressurizes fuel within the injector body. When the fuel pressure reaches a valve opening pressure sufficient to overcome a compression biasing spring, the needle valve member lifts to open the nozzle outlet to commence the injection of fuel.

Each injection event is ended by energizing the second solenoid to pull the spool valve member back to its original position. This movement of the spool valve member ends the exposure of the intensifier piston to the high pressure actuation fluid inlet, and then exposes the piston to a low pressure drain. Without the high pressure force acting on the piston, the piston and plunger cease their downward movement, and fuel pressure under the plunger drops. Eventually, fuel pressure drops below a valve closing pressure that is sufficient to hold the needle valve open, and the needle valve member is then pushed toward its closed position by its compression biasing spring.

Those skilled in the art have long known that, as a general rule, combustion efficiency is improved and undesirable exhaust emissions are reduced when the injection event is ended as abruptly as possible. Several factors contribute to determining how abrupt an injection event ends. Among these are how fast fuel pressure drops, the area of the lifting hydraulic surface exposed to the fuel pressure, the magnitude of the force tending to push the needle valve member toward its closed position and the mass properties of the needle valve member itself.

The present invention is directed to hastening the closure rate of needle valve members in hydraulically-actuated fuel injectors.

DISCLOSURE OF THE INVENTION

A hydraulically-actuated fuel injector includes an injector body that defines an actuation fluid inlet, a first actuation fluid passage, a second actuation fluid passage, a fuel inlet and a nozzle outlet. A solenoid actuated control valve is attached to the injector body and includes a spool valve member moveable between a first position and a second position. The actuation fluid inlet is closed to the first actuation fluid passage but open to the second actuation fluid passage when the spool valve member is in its first position. The actuation fluid inlet is open to the first actuation fluid passage but closed to the second actuation fluid passage when the spool valve member is in its second position. A piston is positioned in the injector body and moveable between a retracted position and an advanced position. The piston has an upper end exposed to fluid pressure in the first actuation fluid passage. A needle valve member is positioned in the injector body and moveable between an inject position in which the nozzle outlet is open, and a closed position in which the nozzle outlet is blocked. The needle valve member has a closing hydraulic surface exposed to fluid pressure in the second actuation fluid passage.

BEST MODE FOR CARRYING OUT THE INVENTION

Figure 1:
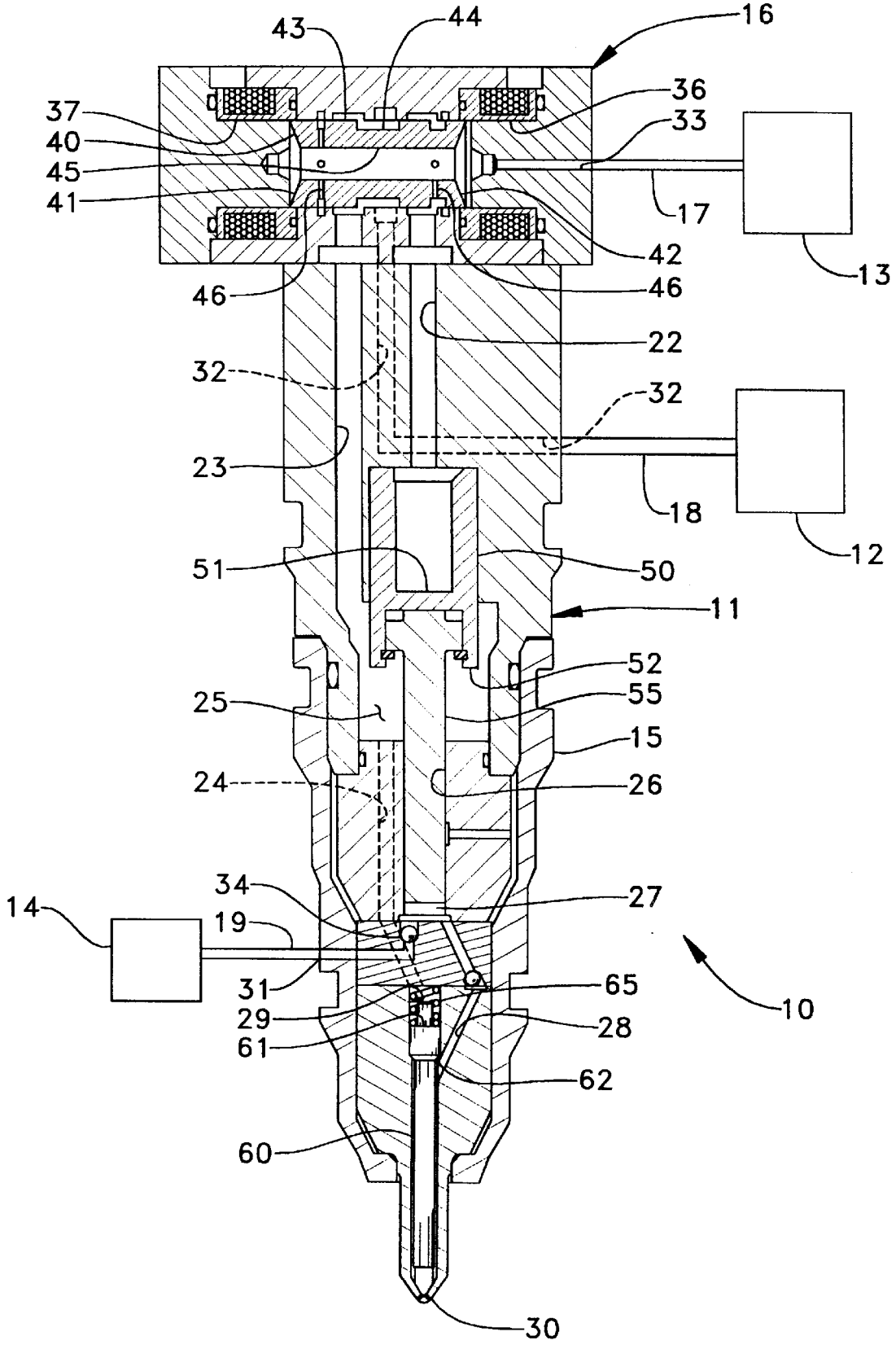
FIG. 1 is a sectioned front diagrammatic view of a fuel injector according to one embodiment of the present invention.

Referring now to FIG. 1, a fuel injection system 10 includes a hydraulically-actuated fuel injector 11 having an injector body 15 made up of a variety of machined components attached to one another in a manner well known in the art. Injector body 15 includes a fuel inlet 31 connected to a source of medium pressure fuel 14 via a fuel supply conduit 19, an actuation fluid inlet 32 connected to a source of high pressure actuation fluid 12 via a supply passage 18, and an actuation fluid drain 33 connected to a low pressure actuation fluid reservoir 13 via a drain conduit 17. Fuel injector 11 is controlled in its operation via a solenoid actuated control valve 16 that moves a spool valve member 40 between a first position and a second position, as shown. Fuel injection system 10 is preferably for use with a diesel type internal combustion engine that supplies distillate diesel fuel to the combustion cylinders within the engine. The high pressure actuation fluid used to actuate fuel injector 11 is preferably a fluid different from fuel, and is preferably engine lubricating oil raised to a relatively high pressure.

The spool valve member 40 of solenoid actuated control valve 16 has a first end 41 separated from a second end 42 by a side surface 43 and a central passage 45. First end 41 and second end 42 have substantially equal hydraulic surface areas, which are both constantly exposed to the low pressure in actuation fluid drain 33. When spool valve member 40 is in its second position as shown, first actuation fluid passage 22 is connected to actuation fluid drain 33 via side passages 46 and central passage 45. At the same time, second actuation fluid passage 23 is connected to high pressure actuation fluid inlet 32 via an annulus 44 formed in the side surface 43 of spool valve member 40. Because ends 41 and 42 of spool valve member 40 are hydraulically balanced, spool valve member 40 will remain in the position shown without either first solenoid 36 or second solenoid 37 being energized. Thus, once moved from one position to another by one of the solenoids 36 or 37, spool valve member 40 will stay in place.

In order to initiate an injection event, first solenoid 36 is energized to pull spool valve member 40 from its second position, as shown, toward the right to its first position. Upon reaching its first position, first solenoid 36 is preferably then de-energized. When spool valve member 40 is in its first position, first actuation fluid passage 22 becomes open to high pressure actuation fluid inlet 32 via annulus 44. At about the same time, second actuation fluid passage 23 becomes open to low pressure actuation fluid drain 33 via side passage 46 and central passage 45. The opening and closing of first and second actuation fluid passageways 22 and 23 to the respective high and low pressures of actuation fluid inlet 32 and actuation fluid drain 33 controls the movement and position of an intensifier piston 50.

Piston 50 is positioned in injector body 15 and moveable between a retracted position, as shown, and a downward advanced position. Piston 50 includes an upper end 51 that is always exposed to whatever fluid pressure exists in first actuation fluid passage 22. Piston 50 also includes a lower end 52 that is always exposed to fluid pressure existing in a lower chamber 25, which is defined by injector body 15. Lower chamber 25 is always open to whatever fluid pressure exists in second actuation fluid passage 23. When spool valve member is in the position shown, lower end 52 is exposed to high fluid pressure, whereas upper end 51 is exposed to low pressure, which causes piston 50 to move toward its retracted position as shown. The pumping stroke of piston 50 is initiated by moving spool valve member 40 toward the right to its first position in order to expose upper end 51 to high actuation fluid pressure and expose its lower end 52 to the low pressure of actuation fluid drain 33.

A plunger 55 is positioned in a plunger bore 26 defined by injector body 15, and has one end attached to piston 50 in a manner well known in the art. In this way, plunger 55 moves with piston 50 between its retracted and advanced positions. A portion of plunger bore 26 and plunger 55 define a fuel pressurization chamber 27 where fuel is pressurized during each injection event. Fuel pressurization chamber 27 is connected to a nozzle outlet 30 via a nozzle supply passage 28. A needle valve member 60 is positioned in injector body 15 and moveable between an inject position in which nozzle outlet 30 is open, and a closed position in which nozzle outlet 30 is blocked to fuel pressurization chamber 27.

Needle valve member 60 includes a lifting hydraulic surface 62 that is exposed to the fuel pressure in nozzle supply passage 28 and fuel pressurization chamber 27. Needle valve member 60 also includes a closing hydraulic surface 61 that is exposed to fluid pressure existing in a needle biasing chamber 29. Needle biasing chamber 29 is always exposed to the fluid pressure in second actuation fluid passage 23 via lower chamber 25 and a pressure communication passage 24. Needle valve member 60 is normally biased toward its closed position by a compression spring 65 that is operably positioned in needle biasing chamber 29.

When piston 50 and plunger 55 are undergoing their upward retracting strokes, fresh fuel is drawn into fuel pressurization chamber 27 past a check valve 34. When piston 50 and plunger 55 are undergoing their downward pumping stroke, fuel is pressurized in fuel pressurization chamber 27 since check valve 34 prevents the back flow of fuel into medium pressure fuel inlet 31.

Each injection event is initiated by energizing first solenoid 36 to pull spool valve 40 from its second position, as shown, to its first position. When this occurs, first actuation fluid passage 22 is suddenly open to the high pressure of actuation fluid inlet 32, and the high pressure previously existing in second actuation fluid passage 23 is suddenly open to the low pressure of actuation fluid drain 33. These fluid pressures cause piston 50 and plunger 55 to begin their downward pumping stroke. When this occurs, fuel pressure in fuel pressurization chamber 27 quickly begins to rise. Eventually, this fuel pressure acting on lifting hydraulic surface 62 of needle valve member 60 is above a valve opening pressure sufficient to overcome the biasing force provided by compression spring 65. When the fuel pressure exceeds this valve opening pressure, needle valve member 60 lifts to its open position and fuel commences to spray out of nozzle outlet 30. After the injection event has begun, first solenoid 36 is de-energized since the hydraulic balancing of spool valve member 40 will keep it in place during the injection event.

Each injection event is ended by energizing second solenoid 37 to pull spool valve member 40 from its first position to its second position, as shown. When this occurs, the high pressure previously existing in first actuation fluid passage 22 is suddenly open to the low pressure of actuation fluid drain 33, and the previously low pressure in second actuation fluid passage 23 is suddenly open to the high pressure of actuation fluid inlet 32. This reverses the hydraulic forces acting on piston 50, causing it to cease its downward travel and begin moving upward toward its retracted position. At the same time, plunger 55 stops moving downward, causing fuel pressure in fuel pressurization chamber 27 to drop rapidly. This drop in fuel pressure acting on lifting hydraulic surface 62 combined with the downward forces provided by biasing spring 65 and the high pressure now acting on closing hydraulic surface 61, cause needle valve member 60 to suddenly move downward to its closed position to abruptly end the injection event.

Figure 2:
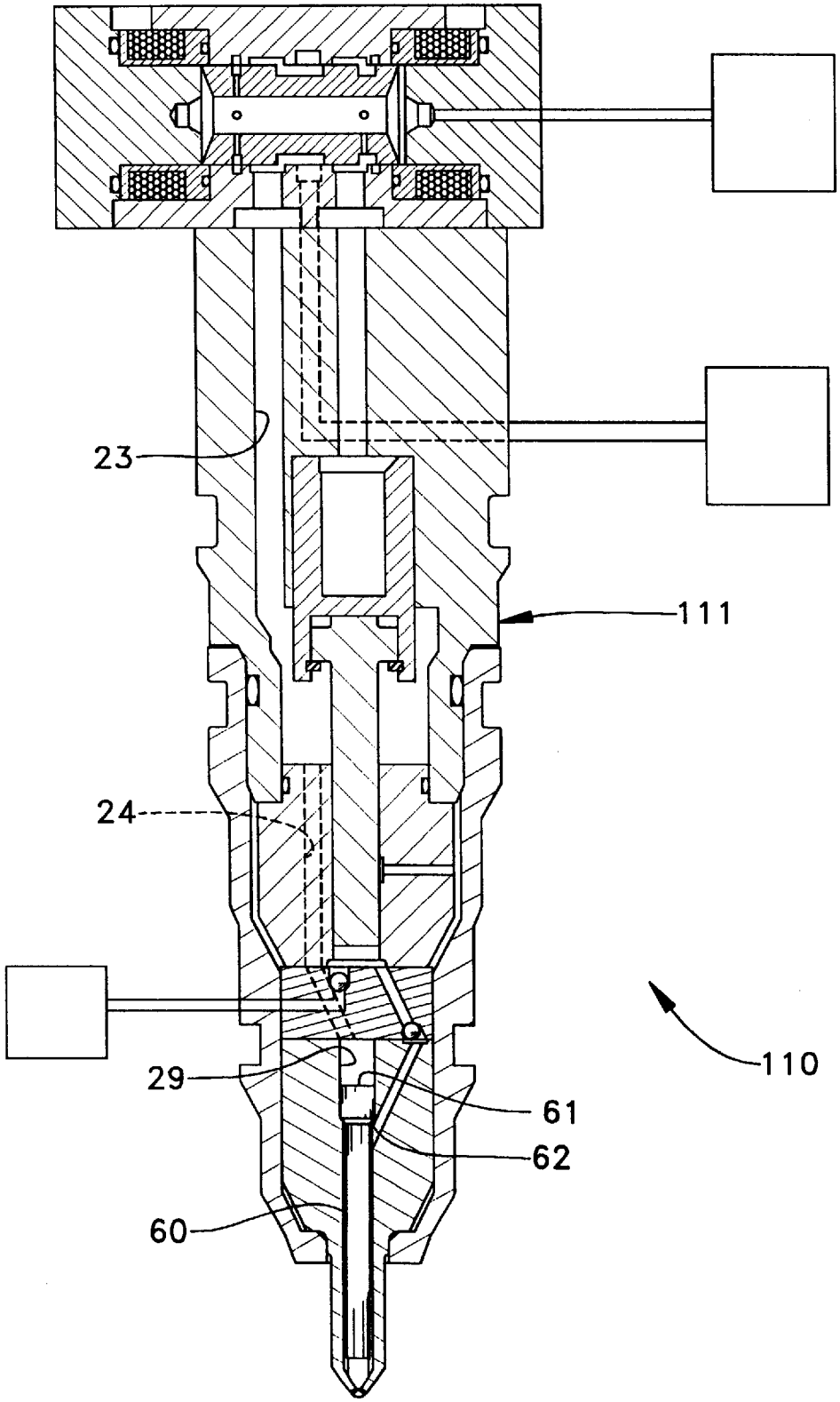
FIG. 2 is a sectioned front diagrammatic view of a fuel injector according to another embodiment of the present invention.

Referring now to FIG. 2, a second embodiment of a fuel injection system 110 includes a fuel injector 111 that is identical in all respects to the previous embodiment except that no compression spring is included to bias needle valve member 60 downward toward its closed position. Instead, fuel injector 11 relies purely upon hydraulic forces acting on opening hydraulic surface 62 and closing hydraulic surface 61 in order to open and close needle valve member 60 at appropriate times. In this embodiment, each injection event ends when second actuation fluid passage 23 is open to the high pressure actuation fluid inlet to expose closing hydraulic surface 61 to relatively high pressure. At the same time this is occurring, fuel pressure acting on lifting hydraulic surface 62 is dropping. These respective hydraulic surfaces are appropriately sized to cause needle valve member 60 to close as quickly as possible at the end of an injection event.

Figure 3:
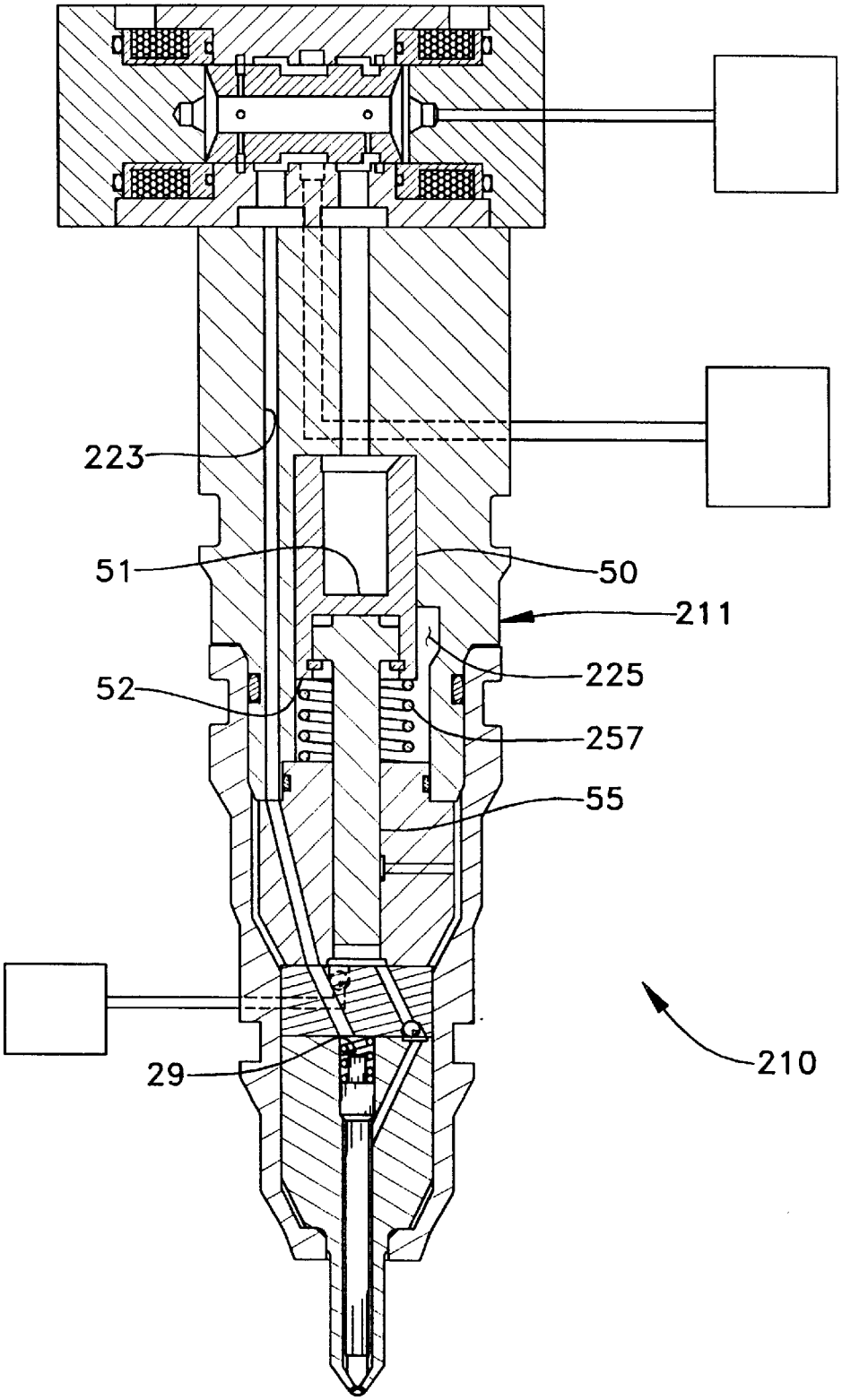
FIG. 3 is a sectioned front diagrammatic view of a fuel injector according to still another embodiment of the present invention.

Referring now to FIG. 3, a fuel injection system 210 includes a fuel injector 211 that is similar in many respects to the fuel injector of FIG. 1, except that in this embodiment piston 50 and plunger 55 are returned to their retracted positions under the action of a return spring, rather than being done so hydraulically as in the embodiments of FIGS. 1 and 2. In this embodiment, second actuation fluid passage 223 is isolated from lower chamber 25 but opens directly into needle biasing chamber 29. Thus, in this example, both piston 50 and plunger 55 are biased toward their retracted positions by a return spring 257. However, when the upper end 51 of piston 50 is exposed to the high fluid actuation fluid pressure, the fuel injector 211 operates the same as the previous embodiments in that piston 50 and plunger 55 move downward in their pumping stroke.

Figure 4:
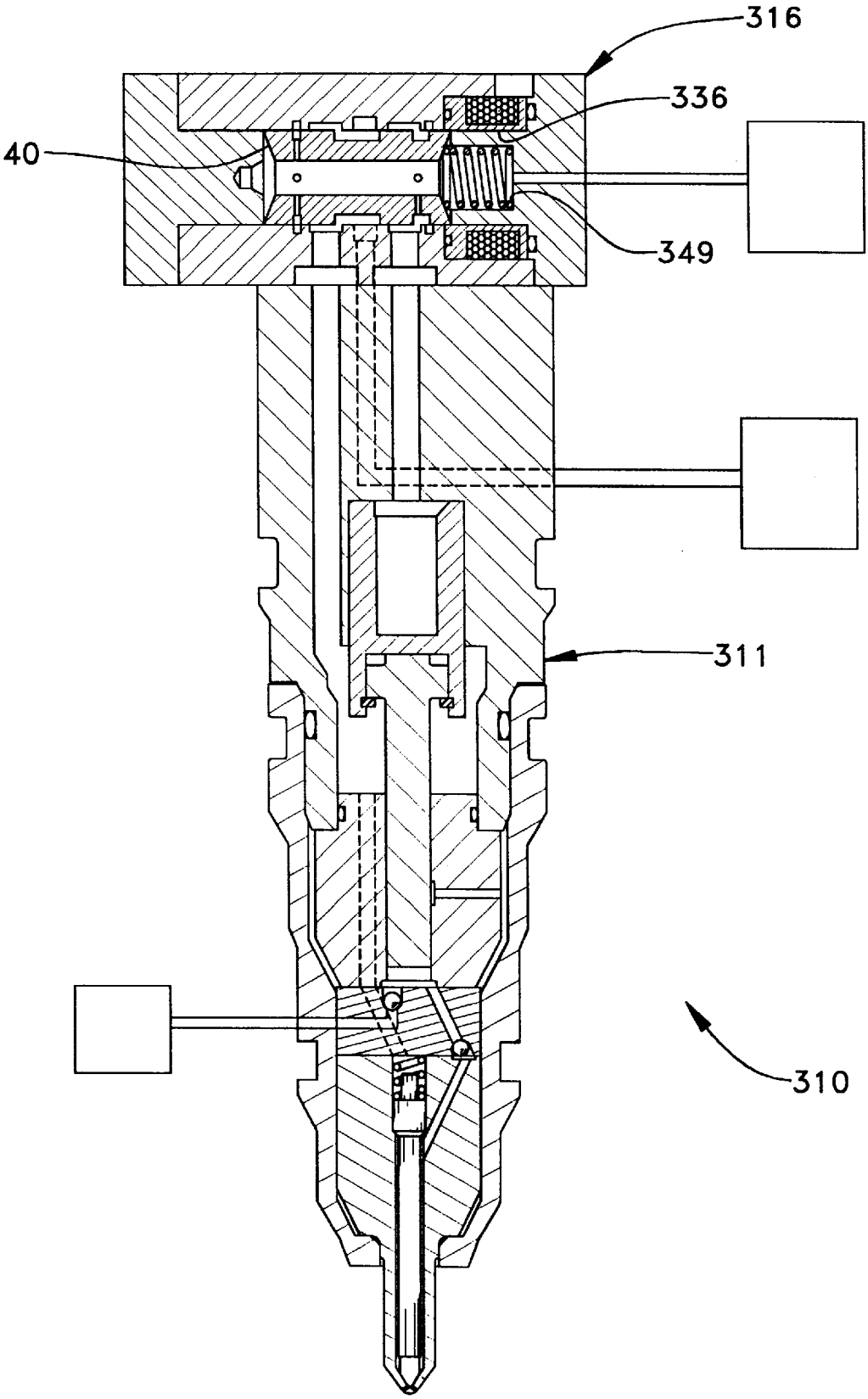
FIG. 4 is a sectioned front diagrammatic view of a fuel injector according to another embodiment of the present invention.

Referring now to FIG. 4, still another embodiment of a fuel injection system 310 includes a fuel injector 311 that differs from the embodiment of FIG. 1 in that control valve 316 includes only one solenoid 336. Instead of using two solenoids as in the previous embodiments, spool valve member 40 is biased toward its second position by a biasing spring 349. Fuel injector 311 performs identically to the earlier embodiments except that solenoid 336 must remain energized during the complete injection event in order to hold spool valve member 40 in its rightward first position. The injection event is ended by de-energizing solenoid 336 so that biasing spring 349 moves spool valve member 40 toward the left to its second position.

Industrial Applicability

Except for the closure of the needle valve member at the end of an injection event, those skilled in the art will appreciate that the fuel injectors of the present invention operate in most respects virtually identical to the fuel injectors described in U.S. Pat. No. 5,460,329 to Sturman. However, the present invention improves upon these earlier injectors by providing a means by which the closure of the needle valve member is hastened in order to provide a more abrupt end to each injection event. Instead of relying only upon a compression spring to push the needle valve member to its closed position at the end of an injection event, the preferred embodiment (FIG. 1) of the present invention adds a hydraulic force to speed the movement of the needle valve member from its open position to its closed position at the end of an injection event. Thus, with the present invention, the engineer has the ability to increase the closure rate of the needle valve member without otherwise altering the other performance features of the injector, such as the valve opening pressure at which the needle valve member lifts to its open position. This can be accomplished since the closing hydraulic surface of the needle valve member does not come into play at the beginning of an injection event since the same is exposed to the low pressure of actuation fluid drain 33 at the beginning of each injection event. Thus, while the needle valve member 60 is biased toward its closed position at the beginning of each injection event only by the biasing spring 65, at the end of each injection event the same is biased toward its closed position both by the spring force and a relatively high hydraulic force.

The above description is intended for illustrative purposes only, and is not intended to limit the scope of the present invention in any way. Those skilled in the art will appreciate that various modifications could be made to the disclosed embodiments without departing from the spirit and scope of the present invention, which is defined in terms of the claims set forth below.

I claim:

1. A hydraulically actuated fuel injector comprising:

an injector body defining an actuation fluid inlet, a first actuation fluid passage, a second actuation fluid passage, a fuel inlet and a nozzle outlet;

a solenoid actuated control valve including a spool valve member positioned in said injector body and being movable between a first position and a second position;

said actuation fluid inlet being closed to said first actuation fluid passage and open to said second actuation fluid passage when said spool valve member is in said first position, and said actuation fluid inlet being open to said first actuation fluid passage and closed to said second actuation fluid passage when said spool valve member is in said second position;

a piston positioned in said injector body and being movable between a retracted position and an advanced position, and said piston having an upper end exposed to fluid pressure in said first actuation fluid passage; and a needle valve member positioned in said injector body and being movable between an inject position in which said nozzle outlet is open, and a closed position in which said nozzle outlet is blocked, and said needle valve member having a closing hydraulic surface exposed to fluid pressure in said second actuation fluid passage.

2. The hydraulically actuated fuel injector of claim 1 wherein said injector body defines an actuation fluid drain; and said actuation fluid drain being open to said first actuation fluid passage and closed to said second actuation fluid passage when said spool valve member is in said first position, and said actuation fluid drain being closed to said first actuation fluid passage and open to said second actuation fluid passage when said spool valve member is in said second position.

3. The hydraulically actuated fuel injector of claim 1 wherein said injector body defines a plunger bore that is open to said nozzle outlet when said needle valve member is in said inject position; and a plunger positioned in said plunger bore with one end in contact with said piston and being movable with said piston between said retracted position and said advanced position.

4. The hydraulically actuated fuel injector of claim 1 wherein said spool valve member has a first end separated from a second end by a side surface with an annulus; and said actuation fluid inlet opens to said annulus.

5. The hydraulically actuated fuel injector of claim 4 wherein said first end and said second end of said spool valve member have substantially equal hydraulic surface areas.

6. The hydraulically actuated fuel injector of claim 1 wherein said spool valve member has a central passage extending between a first end and a second end.

7. The hydraulically actuated fuel injector of claim 1 further comprising a compression spring operably positioned to bias said needle valve member toward said closed position.

8. The hydraulically actuated fuel injector of claim 1 wherein said piston has a lower end exposed to fluid pressure in said second actuation fluid passage.

9. The hydraulically actuated fuel injector of claim 1 further comprising a return spring operably positioned to bias said piston toward said retracted position.

10. The hydraulically actuated fuel injector of claim 1 wherein said control valve includes a first solenoid and a second solenoid attached to said injector body;

said spool valve member being biased toward said first position when said first solenoid is energized and said second solenoid is de-energized; and said spool valve member being biased toward said second position when said second solenoid is energized and said first solenoid is de energized.

11. The hydraulically actuated fuel injector of claim 1 wherein said control valve includes a solenoid that biases said spool valve member toward one of said first position and said second position when energized; and a biasing spring operably positioned to bias said spool valve member toward the other of said first position and said second position when said solenoid is de energized.

12. A hydraulically actuated fuel injector comprising:

an injector body defining an actuation fluid inlet, an actuation fluid drain, an actuation fluid drain, a first actuation fluid passage, a second actuation fluid passage, a fuel inlet and a nozzle outlet;

a solenoid actuated control valve including a spool valve member positioned in said injector body and being movable between a first position and a second position, and said spool valve member having a first end separated from a second end by a side surface with an annulus, and said actuation fluid inlet opens to said annulus;

said actuation fluid inlet being closed to said first actuation fluid passage and open to said second actuation fluid passage when said spool valve member is in said first position, and said actuation fluid inlet being open to said first actuation fluid passage and closed to said second actuation fluid passage when said spool valve member is in said second position;

said actuation fluid drain being open to said first actuation fluid passage and closed to said second actuation fluid passage when said spool valve member is in said first position, and said actuation fluid drain being closed to said first actuation fluid passage and open to said second actuation fluid passage when said spool valve member is in said second position.

a piston positioned in said injector body and being movable between a retracted position and an advanced position, and said piston having an upper end exposed to fluid pressure in said first actuation fluid passage; and a needle valve member positioned in said injector body and being movable between an inject position in which said nozzle outlet is open, and a closed position in which said nozzle outlet is blocked, and said needle valve member having a closing hydraulic surface exposed to fluid pressure in said second actuation fluid passage.

13. The hydraulically actuated fuel injector of claim 12 further comprising a compression spring operably positioned to bias said needle valve member toward said closed position.

14. The hydraulically actuated fuel injector of claim 13 wherein said piston has a lower end exposed to fluid pressure in said second actuation fluid passage.

15. The hydraulically actuated fuel injector of claim 14 wherein said control valve includes a first solenoid and a second solenoid attached to said injector body;

said spool valve member being biased toward said first position when said first solenoid is energized and said second solenoid is de-energized; and said spool valve member being biased toward said second position when said second solenoid is energized and said first solenoid is de energized.

16. The hydraulically actuated fuel injector of claim 12 further comprising a return spring operably positioned to bias said piston toward said retracted position.

17. The hydraulically actuated fuel injector of claim 12 wherein said control valve includes a solenoid that biases said spool valve member toward one of said first position and said second position when energized; and a biasing spring operably positioned to bias said spool valve member toward the other of said first position and said second position when said solenoid is de energized.

18. A fuel injection system comprising:

a fuel injector having an injector body defining an actuation fluid inlet, a first actuation fluid passage, a second actuation fluid passage, a fuel inlet and a nozzle outlet;

a source of high pressure actuation fluid connected to said actuation fluid inlet;

a source of low pressure fuel connected to said fuel inlet;

a solenoid actuated control valve movable between a first position and a second position, said actuation fluid inlet being closed to said first actuation fluid passage and open to said second actuation fluid passage when said control valve is in said first position, and said actuation fluid inlet being open to said first actuation fluid passage and closed to said second actuation fluid passage when said control valve is in said second position;

a piston positioned in said injector body and being movable between a retracted position and an advanced position, and said piston having an upper end exposed to fluid pressure in said first actuation fluid passage; and a needle valve member positioned in said injector body and being movable between an inject position in which said nozzle outlet is open, and a closed position in which said nozzle outlet is blocked, and said needle valve member having a closing hydraulic surface exposed to fluid pressure in said second actuation fluid passage.

19. The fuel injection system of claim 18 wherein said control valve includes a spool valve member positioned in said injector body and being movable between said first position and said second position, and said spool valve member having a first end separated from a second end by a side surface with an annulus, and said actuation fluid inlet opens to said annulus.

20. The fuel injection system of claim 19 wherein said actuation fluid is different from said fuel.

* * * * *